United States Patent [19]

Walker

[11] Patent Number: 4,945,847

[45] Date of Patent: Aug. 7, 1990

[54] WINGSAIL FLAP DEFLECTION SYSTEM

[76] Inventor: John G. Walker, Tipwell House, St Mellion, Cornwall PL12 8RS, United Kingdom

[21] Appl. No.: 222,822

[22] Filed: Jul. 22, 1988

Related U.S. Application Data

[63] Continuation-in-part of Ser. No. 5,167, Jan. 2, 1987, Pat. No. 4,770,113.

[30] Foreign Application Priority Data

May 2, 1985 [GB] United Kingdom ..... 8511232
May 2, 1985 [GB] United Kingdom ..... 8511233
May 2, 1985 [GB] United Kingdom ..... 8511234
May 2, 1985 [GB] United Kingdom ..... 8511235

[51] Int. Cl.[5] ..... B63H 9/04
[52] U.S. Cl. ..... 114/102; 114/103
[58] Field of Search ..... 114/102, 103, 39.1, 114/167; 244/82

[56] References Cited

U.S. PATENT DOCUMENTS 4,467,741 8/1984 Walker ..... 114/103
4,543,899 10/1985 Walker ..... 114/102

FOREIGN PATENT DOCUMENTS 2144573 4/1973 Fed. Rep. of Germany ..... 114/103
1375191 11/1974 United Kingdom ..... 114/103

*Primary Examiner*—Sherman D. Basinger
*Attorney, Agent, or Firm*—Young & Thompson

[57] ABSTRACT

A method of operating a multi-element self-trimming sailset to assist deflection of the trailing element of the main thrust wing to either side of the leading element. The sailset is first rotated to reduce the moment of wind on the flap opposing deflection, the flap is deflected, and then the sailset rotated to its operating angle of attack. Rotation of the sailset is achieved by a tail vane.

5 Claims, 3 Drawing Sheets

WINGSAIL FLAP DEFLECTION SYSTEM

This invention which is a continuation-in-part of my application Ser. No. 005,197 filed Jan. 2, 1987, now U.S. Pat. No. 4,770,113, relates to wingsail airfoils for land or marine vehicles and to arrangements for relative deflection of elements in a multi-element wingsail system.

A wingsail airfoil is mounted and operated somewhat differently from the more familiar aeroplane wing; it is mounted with the span upright and the airfoil section plane substantially horizontal, and since the vehicle to which the wingsail is attached is supported by land or water the airfoil is used to supply or augment propulsive power which for practical purposes needs to be capable of being applied both left and right of the wind. The type of wingsail assembly with which the present invention is concerned is a self-setting or self-trimming wingsail assembly. Such a wingsail assembly comprises a set of symmetrical airfoils, termed hereinafter a sailset, having at least one thrust wingsail that reacts the propulsive force and is freely rotatable about an upright axis so that it can be trimmed to different angles in accordance with the wind and desired direction of travel, and at least one symmetrical auxiliary airfoil (usually a tail airfoil) mounted on a boom or booms rigidly connected to the leading airfoils of the thrust wingsail and which is used to trim the thrust wingsail as explained hereinafter.

The thrust wingsail is of multi-element structure comprising a symmetrical leading airfoil element or wing and a symmetrical trailing airfoil element or flap positioned closely behind the wing, the flap being laterally pivotable with respect to the wing so that the wingsail can adopt an asymmetrical configuration for thrust left or right of the wind. The flap can be locked in the thrusting position and released for returning to the aligned position or to a mirror image deflected position. Generally the axis of free rotation of the sailset passes through the zone containing the upstream and downstream range of locations of the centre of pressure of the sailset. When the symmetrical airfoils are all in line the sailset will lie like a weathercock in the position of minimum air resistance. If the thrust wingsail is then set to the thrusting configuration by deflecting and locking the flap the wind creates a turning moment about the main axis. However the auxiliary airfoil can also be independently rotated and although much smaller, it is, by virtue of its distance from the main axis, capable of exerting a comparable moment. Thus by selection of the angular deflection of the auxiliary airfoil (that is selection of its moment compared with the thrust wingsail moment about the main axis for a given angular deflection of the thrust wing) the trim angle of the thrust wing to the wind can be selected, and upon a change of wind direction the resulting change in the moments of the thrust wingsail and auxiliary airfoil about the main axis will cause a natural rotation of the sailset until the moments again balance when the trim angle of the thrust wingsail to the wind is restored to its original value.

The direction of travel of the vehicle with respect to prevailing wind direction may be considered to fall into three general categories: towards the wind, broadly across wind, and away from or downwind, and for each of these categories different settings with respect to the wind are preferable. In between the general categories the best settings will be intermediate those exemplified below with respect to the general categories.

If the vehicle is being propelled substantially towards the wind the trim is usually adjusted to provide the maximum possible aerodynamic efficiency, commonly termed the lift/drag ratio; which is the ratio of the output force resolved into components at right angles to the wind and in the direction of the wind. If the direction is broadly across the wind the trim is adjusted to provide the maximum force available without stalling, and if the travel is generally downwind then the downwind component of force is maximised, with stalling deliberately enabled if found more effective.

In the configurations with flap or flaps deflected, the moment about the hinge of a deflected trailing airfoil due to airflow is considerable, and must be resisted if the flap deflected configuration is to be maintained. If a hydraulic ram is used to drive the flap and maintain its position, this necessitates use of a ram large enough to withstand the maximum moment likely to be encountered. Even if a locking device is employed in order to relieve the ram once the flap is fully deflected the hydraulic ram still has to be powerful enough to defect the flaps in a strong airstream.

Aircraft flaps incorporate devices such as rails and fixed pivots in order to alleviate any analogous problems, however this method is not easily adaptable for wingsail systems because, unlike aircraft, the trailing section or flap must be capable of deflection in both directions in order to operate on both tacks.

An object of the present invention is to provide a method that assists the flap to reach operating deflection.

Accordingly the present invention provides a method of operating a self-trimming sailset comprising a thrust wing having a symmetrical leading airfoil and a symmetrical trailing airfoil flap and a symmetrical tail airfoil, the method comprising adjusting the angle between the tail and the leading airfoil to rotate the sailset towards a position in which the moment opposing a movement of the flap in a particular direction is reduced, moving the flap in said particular direction, locking the flap system mechanically and then readjusting the tail to trim the sailset to the desired angle of attack.

The operation may be reversed to provide forces tending to aid movement of the flap in the opposite direction.

The invention also relates to a control system for moving the flap of the self-trimming rig. Although described with reference to a single plane thrust wing the invention is also applicable to multi-plane thrust wings, in which instance the flaps may be independently controlled or moved in unison.

The invention is now described by way of example with reference to the accompanying drawings in which.

Figure 2:
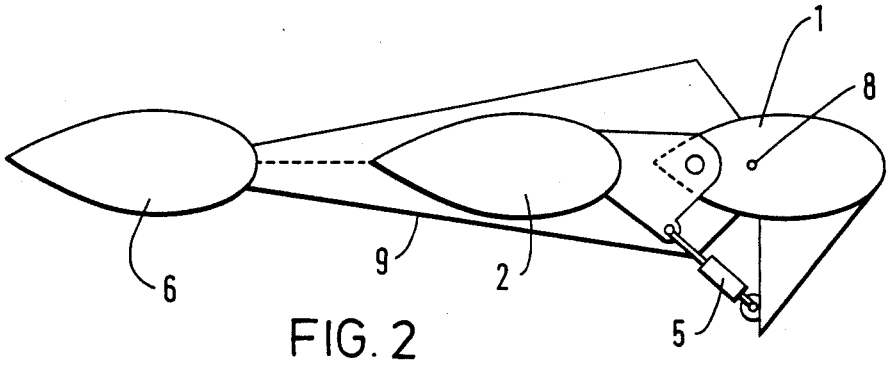
FIG. 2 is a schematic diagram of a self trimming wingsail rig or sailset with all airfoils aligned.

Referring to the drawings, a schematic illustration of the elements of a self-trimming wingsail sailset is shown in FIG. 2. A main thrust wing is composed of a leading airfoil 1 and a trailing airfoil 2, known as a flap, and an auxiliary tail airfoil 6 is mounted on a boom or booms 9 extending from the leading section. The main thrust wing is shown as a monoplane (i.e. a set comprising one leading and one trailing airfoil) but it should be realised that a plurality of parallel or substantially parallel leading and trailing airfoil sets may be provided in a multi-plane structure. Usually only a single auxiliary (tail) airfoil is provided even on multi-plane sailsets. Whether monoplane or multi-plane, the whole assembly of thrust wing and tail is freely rotatable about a main bearing axis 8 which passes generally through the zone defining the upstream/downstream range of locations of centre of pressure of the monoplane or multi-plane set.

Figure 1:
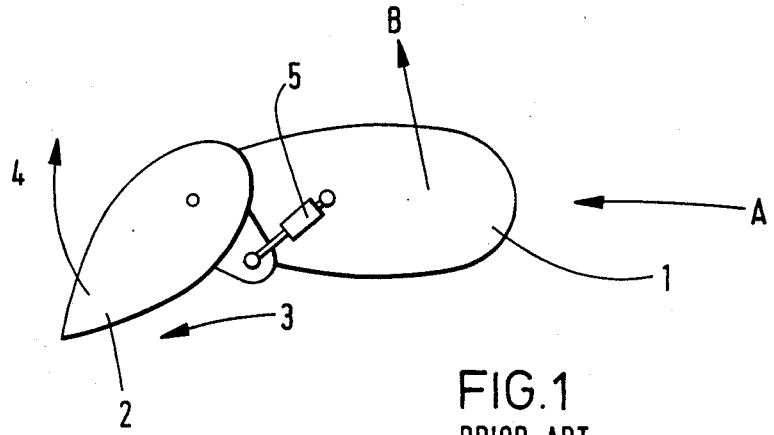
FIG.1 PRIOR ART
FIG. 1 is a schematic diagram of a two section wingsail showing the hinge moment.

Referring now to FIG. 1 the thrust wingsail is shown schematically in a configuration in which, with the wind coming from a approximate direction A and the flap 2 deflected as shown, thrust is provided in the approximate direction B to propel or assist in the propulsion or manoeuvring of the vehicle to which it is fitted. The airflow, shown generally by the arrow 3, creates a positive pressure on the windward side of the flap and a negative pressure on the leeward side of the flap producing a moment tending to rotate the flap away from its deflected position as shown by arrow 4. It will be seen that the movement of the flap is here simply resisted by a hydraulic ram 5 designed to deflect the flap. A locking pin or other locking device may be incorporated in order to relieve the stress on the hydraulic system while deflected, but the flap moving system is still subject to stress when moving the flap in a strong airstream, and unless the system is very powerful (and therefore both expensive and a heavy member for the wingsail to carry) it may become overstressed before the position is reached at which the locking pin or other device can be inserted to render assistance.

Figure 3:
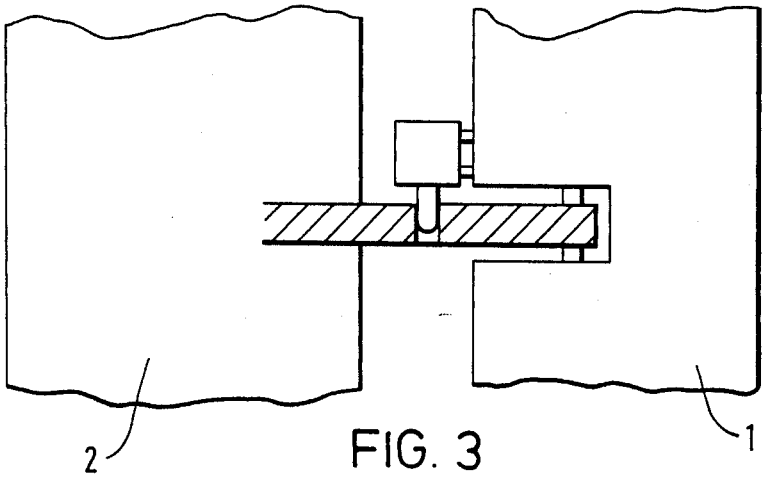
FIG. 3 is a diagram of a hydraulically operated pinlock arranged to lock a hinged flap to a leading airfoil.
Figure 4:
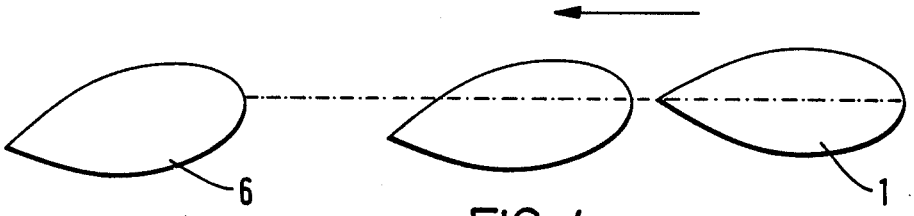
FIGS. 4 and 6 are schematic diagrams of a self-trimming wingsail rig undergoing flap deflection.

In order to reduce the stress on the flap moving system when the flaps are being deflected, a method of operating a self trimming wingsail system has been devised in which the trimming system is operated during the process of flap deflection in order to reduce the moment opposing flap movement. The method of operating the self-trimming rig to reduce or eliminate flap hinge moments during flap deflection comprises rotating the tail (as shown in FIG. 4) so that the trailing edge of the tail is deflected to the same side as that to which it is intended to set the flap on the thrust wing at the same time as commencing moving or allowing the flap to move towards its new position. This rotation of the tail tends to rotate the airfoil assembly about the main axis so that the resistive force from the wind on the flap is much reduced, or even eliminated and replaced by a force assisting deflection, in which case flap deflecting means may be eliminated. Once the flap is fully deflected it can be locked in a position, for example as shown in FIG. 3, and the tail is readjusted to trim the wingsail assembly until the thrust wingsail is at the desired angle of attack.

This sequence is shown in FIGS. 2 and 4 through 7, commencing from the aligned position shown in FIG. 2 in which the tail 6 is aligned with the plane of symmetry of the leading airfoil of the main thrust wing, with which the flap 2 is also aligned. The assembly is at all times freely rotatable about the main axis 8 to 'weathercock' to the wind. In general a plurality of thrust wings will be arranged alongside each other and be interconnected to be trimmed as a unit by the tail, with the flaps interconnected to move together. The device for moving the flap or flaps may be a hydraulic ram 5 mounted on a spar 7, as shown in FIG. 2, but may be omitted.

Figure 5:
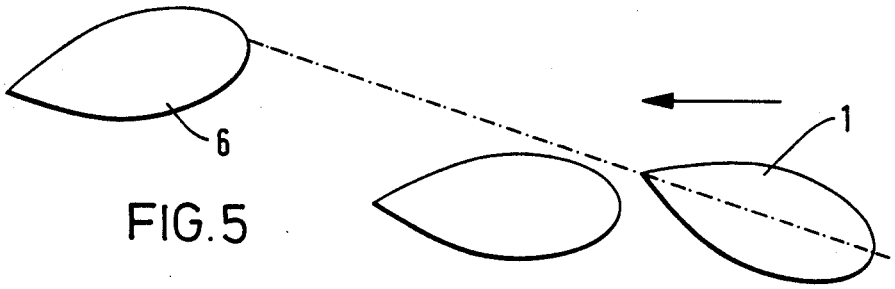
Figure 6:
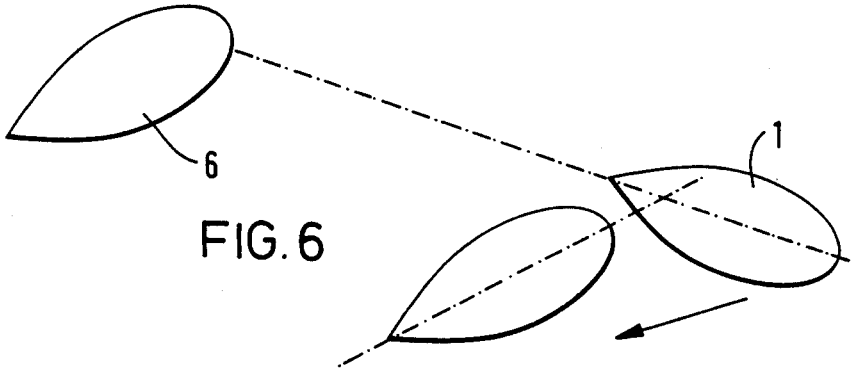
Figure 7:
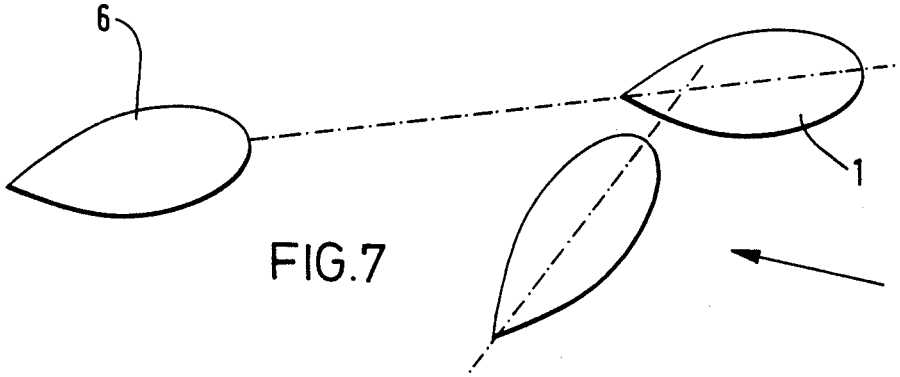
FIG. 7 is a schematic diagram of a self trimming wingsail rig with a tail airfoil set for trimming.

In FIG. 4 the operation for setting the flap right of wind is commenced: the tail is rotating towards its maximum deflection right of wind and, by virtue of the wind force reacting on the tail acting through the lever arm of booms 9, the complete assembly is rotated about the main axis as shown in FIG. 5. Deflection of the flap 2 to the right of the wind direction towards the position shown in FIG. 6 is now aided by the wind, and upon achieving the correct deflection the flap 2 is locked in position by some means such as shown in FIG. 3 to relieve the moving mechanism, if fitted, of further stress. FIG. 7 shows the tail subsequently set at a different angle to trim the complete assembly to achieve the desired angle of attack of the main thrust wing. The same procedure can be repeated in reverse for the other tack.

Figure 8:
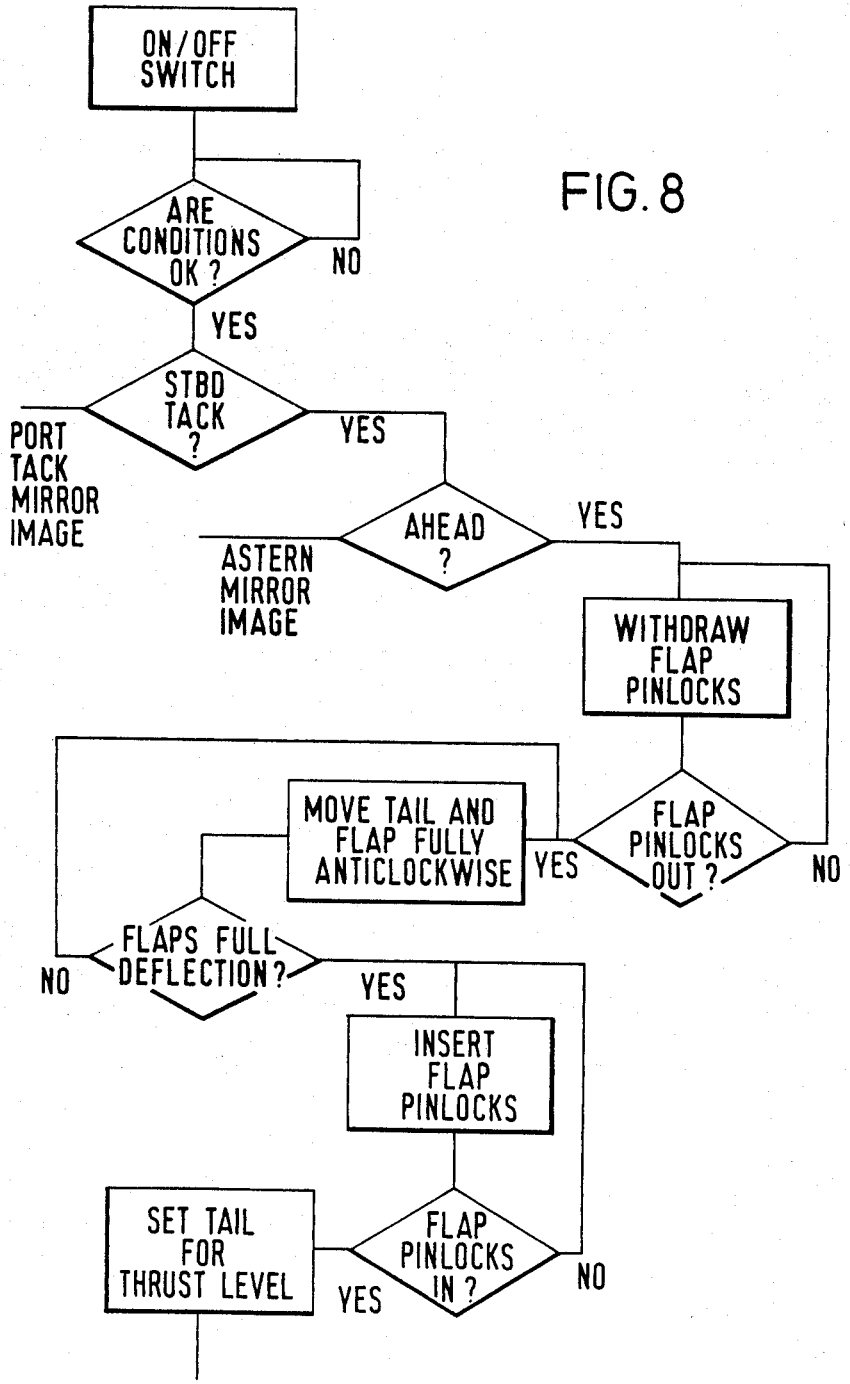
FIG. 8 is a flow diagram for a control system for changing tack in a self-trimming wingsail rig.

Preferably the sailing conditions are monitored continually by a control system which may include one or more electronic microprocessors which can ascertain whether a change of flap deflection, such as for changing tack, is required. The system may also respond to over-ride commands, such as for manoeuvring. FIG. 8 shows a simplified flow diagram for the change of tack control system.

I claim:

1. A method of operating a self-trimming sailset comprising a thrust wing having a leading airfoil and a trailing airfoil flap and a trimming tail airfoil, the method comprising adjusting the angle between the tail and the leading airfoil to rotate the sailset towards a position in which the moment opposing a movement of the flap in a particular direction is reduced, moving the flap in said particular direction, and then readjusting the tail to trim the sailset to the desired angle of attack.

2. The method of claim 1 wherein the flap is locked in position after movement in said direction.

3. The method of claim 1 in which the tail is adjusted to its maximum deflection in one direction and the flap is deflected in the same direction.

4. The method of claim 3 in which the movement of the tail and flap are commenced simultaneously.

5. A method of operating a self-trimming sailset comprising at least one thrust wing each having a leading airfoil and a trailing airfoil flap, and a trimming tail airfoil, the method comprising adjusting the angle between the tail and the leading airfoil to rotate the sailset towards a position in which wind force acts to move the flap in a particular direction, permitting the flap to move in said particular direction and subsequently readjusting the tail to trim the sailset to the desired angle of attack.

* * * * *